United States Patent [19]

Sautebin

[11] Patent Number: 4,508,160

[45] Date of Patent: Apr. 2, 1985

[54] PROCESS FOR COOLING IN INGOT DURING CONTINUOUS CASTING

[75] Inventor: Raoul Sautebin, Sierre, Switzerland

[73] Assignee: Swiss Aluminium Ltd., Chippis, Switzerland

[21] Appl. No.: 436,593

[22] Filed: Oct. 25, 1982

[30] Foreign Application Priority Data

Nov. 20, 1981 [CH] Switzerland ..... 7448/81

[51] Int. Cl.[3] ..... B22D 11/124

[52] U.S. Cl. ..... 164/467; 164/128; 164/486; 164/487

[58] Field of Search ..... 164/486, 487, 122, 128, 164/472, 444, 467

[56] References Cited

U.S. PATENT DOCUMENTS 3,397,734 8/1968 Brown ..... 164/472

3,543,831 12/1970 Schile ..... 164/486 X 4,166,495 9/1979 Yu ..... 164/486

*Primary Examiner*—Nicholas P. Godici

*Assistant Examiner*—J. Reed Batten, Jr.

*Attorney, Agent, or Firm*—Bachman and LaPointe

[57] ABSTRACT

The cooling of a continuously cast ingot of metal as it emerges from the mold is carried out by applying coolant directly to the ingot surface. In order to reduce the amount of curvature at the foot of the ingot due to too rapid cooling, a substance which releases a gas as a product of decomposition on striking the hot ingot surface is added to the coolant at least during the initial phase of casting. This gas forms an insulating film on the ingot surface thus reducing the rate of heat extraction. Particularly suitable for this purpose are substances which produce carbon dioxide or nitrogen as decomposition product.

14 Claims, No Drawings

PROCESS FOR COOLING IN INGOT DURING CONTINUOUS CASTING

BACKGROUND OF THE INVENTION

The invention relates to a process for cooling metal during casting as it emerges from a mold and this by applying coolant directly onto the surface of the metal, as a result of which at least during the start-up phase a gas is released from the coolant.

During continuous direct chill casting of metal the strand or ingot of metal is jetted with a coolant directly on the surface as the ingot leaves the mold i.e. heat is extracted from the metal immediately below the mold. During the start-up phase of casting the coolant first strikes only the dummy base. The resultant indirect extraction of heat produces a moderate rate of solidification of the liquid metal and flat shape of that end of the ingot. As the dummy base is lowered further, the coolant strikes the surface of the ingot directly, which causes a sudden increase in the rate of heat extraction from the ingot. The thermal stresses resulting from this thermal shock exceed the yield strength of the ingot and lead to a permanent deformation in the form of a convex curvature at the foot of the ingot; on exceeding the tensile strength of the material at that temperature they lead to tears or cracks in the ingot. In order to obtain an ingot with a flat starting end therefore, the ingot must not be cooled too intensively at the start-up of casting.

A process is known in which, at least at the start of casting, the coolant contains a gas introduced into it under pressure. As the coolant strikes the surface of the ingot, the gas thus dissolved in the coolant forms a thermally insulating layer which reduces the cooling intensity.

The disadvantages of this process are the expensive mixing and control facilities needed to dissolve the gas in the coolant and the fact that, because of the generally low solubility of gases in water which is principally used as coolant here, the process is practically limited to the use of carbon dioxide.

SUMMARY OF THE INVENTION

In view of the above the object of the present invention is to improve a process of the kind mentioned above, whereby the above mentioned disadvantages are eliminated.

This object is achieved by way of the invention in that a substance which produces gas as a decomposition product on striking the hot ingot surface is mixed into the coolant.

Using the process according to the invention the principle of reducing the intensity of cooling by means of an insulating gas film can be realized in a simple manner. The substance can be in a highly concentrated form, for example forming a saturated coolant solution, fed into a coolant supply line from a storage tank via a controlled feed pump. As the gas forms by decomposition only when it strikes the hot ingot surface, no special pressure and mixing facilities are required.

DETAILED DESCRIPTION

Suitable for carrying out the process are basically all substances which exhibit good solubility in the coolant and on decomposing produce no gases which are aggressive or a danger to health. Substances which come into question are therefore basically those which release carbon dioxide or nitrogen when they decompose.

If water is employed as coolant, then hydrogen-bicarbonates, in particular sodium or ammonium bicarbonates, in the dissolved state can be used. Likewise organic compounds in the dissolved state with at least one carboxyl group, for example acids or esters, can be employed.

As carbonates dissolved in water are in equilibrium with carbon dioxide, and carbon dioxide is more readily released by lowering the pH-value, in a further version of the process according to the invention acid can be added to the substance.

When using water as coolant, substances which produce nitrogen as a product of decomposition are particularly suitable as they are not in aqueous equilibrium with nitrogen, and their behavior is independent of the pH.

A particularly suitable additive to the water used as coolant is ammonium nitrite. This can also be introduced into the coolant as an equimolar mixture of sodium nitrite and ammonium nitrate.

The process according to the invention can be realized both with the conventional D.C. molds and with electromagnetic casting molds, and is especially suitable for casting light metals, in particular aluminum and aluminum alloys. The concentration of the substance is selected in accordance with the desired reduction in cooling intensity, and normally is of the order of $10^{-1}$ to $10^{-3}$ mole/liter.

After completion of the start-up phase, the addition of the substance to the coolant can be stopped. In another version of the process the concentration of the substance in the coolant is reduced continuously during the start-up phase. In certain cases, however, it can be shown to be useful to continue the process according to the invention throughout the whole of the casting period.

Further advantages, features and details of the process are revealed in the following description of preferred exemplified embodiments of the invention.

An aluminum alloy 3004 was cast on a vertical continuous casting unit with electromagnetic molds employing normal casting conditions. Ingots of format 500 mm × 1600 mm were cast. The supply of cooling water was kept constant at 600 liter/minute throughout the whole of casting. During the casting of the first 100 mm of ingot length, the substances listed in the table below were mixed into the cooling water. For this purpose a saturated aqueous solution of the substance in question was fed from a storage tank via a controlled feed pump directly into the main cooling water supply line. The concentrations of the substances in the cooling water are likewise listed in the table. The substances were added to the cooling water only during the start-up phase; after this no further addition was made to the water.

TABLE

Concentration of the substances in the storage tank and in the cooling water.

| Substance | Concentration (mole/liter) in storage tank | Concentration (mole/liter) in cooling water |
|---|---|---|
| $NaHCO_3$ | 1.1 | $10^{-1}$–$10^{-2}$ |
| $NH_4HCO_3$ | 1.5 | $10^{-1}$–$10^{-2}$ |
| $NH_4NO_2$ | 12 | $10^{-2}$–$10^{-3}$ |

By maintaining the above listed concentrations of the substances in the cooling water during the start-up phase a practically curvature-free and crack-free ingot was obtained as a result of the reduced cooling intensity.

What is claimed is:

1. A process which comprises: casting an ingot in a mold; providing a coolant having added thereto a substance which is soluble in the coolant and which releases gas as a decomposition product on striking a hot ingot surface; and applying said coolant-substance mixture to the surface of the ingot as it emerges from the mold, thereby decomposing said substance, releasing a gas as a decomposition product, to form an insulating film on the ingot surface and reducing the rate of heat extraction.

2. A process according to claim 1 wherein said ingot is continuously cast.

3. A process according to claim 1 wherein said substance releases carbon dioxide as the product of decomposition.

4. A process according to claim 3 wherein water is employed as said coolant and a bicarbonate in dissolved form is employed as said substance.

5. A process according to claim 4 wherein said bicarbonate is sodium bicarbonate.

6. A process according to claim 4 wherein said bicarbonate is ammonium bicarbonate.

7. A process according to claim 3 wherein water is employed as said coolant and an organic compound with at least one carboxyl group in dissolved form is employed as said substance.

8. A process according to claim 1 wherein said substance releases nitrogen as the decomposition product.

9. A process according to claim 8 wherein water is employed as said coolant and ammonium nitrite in dissolved form is employed as said substance.

10. A process according to claim 8 wherein water is employed as said coolant and an equimolar mixture of sodium nitrite and ammonium nitrate in dissolved form is employed as said substance.

11. A process according to claim 1 wherein the substance is added to the coolant to produce a concentration thereof $10^{-1}$ to $10^{-3}$ mole/liter.

12. A process according to claim 1 wherein the substance is added to the coolant in controlled amounts in the form of a saturated solution.

13. A process according to claim 1 wherein said ingot is cast in a DC casting mold.

14. A process according to claim 1 wherein said igot is cast in an electromagnetic casting mold.

* * * * *

UNITED STATES PATENT AND TRADEMARK OFFICE

CERTIFICATE OF CORRECTION

PATENT NO. : 4,508,160

DATED : April 2, 1985

INVENTOR(S) : Raoul Sautebin

It is certified that error appears in the above-identified patent and that said Letters Patent are hereby corrected as shown below:

Change the title to read: --PROCESS FOR COOLING AN INGOT DURING CONTINUOUS CASTING--.

Column 3, claim 1, line 14, after "product" delete ",".

Signed and Sealed this

*Fourteenth* Day of *January 1986*

[SEAL]

*Attest:*

*Attesting Officer*

DONALD J. QUIGG

*Commissioner of Patents and Trademarks*